United States Patent [19]

Feagin

[11] 4,196,769

[45] Apr. 8, 1980

[54] CERAMIC SHELL MOLD

[75] Inventor: Roy C. Feagin, Boca Raton, Fla.

[73] Assignee: Remet Corporation, Chadwicks, N.Y.

[21] Appl. No.: 889,142

[22] Filed: Mar. 20, 1978

[51] Int. Cl.[2] ..... B22C 9/04; B22C 1/18

[52] U.S. Cl. ..... 164/26; 249/38.22; 164/25; 164/138; 164/41; 106/38.27; 106/65; 249/134

[58] Field of Search ..... 164/20, 21, 25, 26, 164/41, 138, 361; 106/38.2, 38.22, 308 B, 38.3, 38.9, 65

[56] References Cited

U.S. PATENT DOCUMENTS

| | | | |
|---|---|---|---|
| 2,239,530 | 4/1941 | Langenohl et al. | 164/41 |
| 3,166,808 | 1/1965 | Moore | 164/41 |
| 3,445,250 | 5/1969 | Preece | 106/38.22 |
| 3,534,803 | 4/1967 | Bickerdike | 164/138 |
| 3,654,984 | 4/1972 | Mellen, Jr. et al. | 164/41 |
| 3,752,689 | 8/1973 | Moore, Jr. | 106/38.3 |
| 3,933,190 | 1/1976 | Fassler et al. | 164/26 |
| 3,935,023 | 1/1976 | Derolf | 106/308 B |

*Primary Examiner*—Robert D. Baldwin
*Assistant Examiner*—K. Y. Lin
*Attorney, Agent, or Firm*—Wenderoth, Lind & Ponack

[57] ABSTRACT

Method for making a novel shell mold for use in directional solidification and for casting alloys containing reactive components, wherein a binder comprising a fibrous colloidal alumina in aqueous dispersion and being essentially free of silica, is employed. The resultant shell mold is particularly suitable for the casting of nickel and cobalt based alloys containing relatively reactive constituents such as zirconium, alumina and titanium.

22 Claims, No Drawings

CERAMIC SHELL MOLD

BACKGROUND OF THE INVENTION

This invention relates to the manufacture of refractory coatings and in particular, shell molds for use in directional solidification and for casting alloys containing reactive components.

The predominant process for making small and intricate castings such as turbine blades, vanes, nozzles and many other parts is the ceramic shell mold process. A group of expendable patterns of parts to be cast are made, for example, in wax, and set up into a cluster. This cluster is then dipped into a ceramic slurry, removed and coarse refractory is sprinkled on the wet slurry coating and allowed to harden or "set". This process is repeated several times until a sufficient thickness of ceramic is built up onto the wax pattern. Drying or chemical setting can be carried out on each layer. After the final thickness is reached, the entire assembly is "set" or dried. The wax is then removed by one of several acceptable techniques, such as in a steam autoclave or by actually firing the mold to melt out the wax. The mold is then preheated to an appropriate temperature and the metal is poured into the resulting mold.

Instead of conventional wax, the expendable pattern may be formed of polystyrene, plastic modified wax etc.

The usual refractories used in this system are fused silica, crystalline silica, aluminosilicates, zircon, and alumina.

Heretofore, bonding of these refractory particles has been mostly carried out by an alcoholic solution of hydrolyzed ethyl silicate or a colloidal dispersion of silica in water. Upon drying of the shell molds, the silica serves as a bond for the refractory particles. Typical ceramic shell mold processes are given in the following U.S. patents: Nos. 3,165,799, 3,933,190, 3,005,244 and 3,955,616.

The deficiencies of silica-bonded shell molds are particularly apparent in the directional solidification technique of casting.

Such technique has been developed for producing castings having directionally solidified grains, which is particularly applicable to the manufacture of turbine blades wherein the blade has longitudinal grains, whereby the high temperature properties are improved as a result of the grain structure. One of the techniques used in producing such structures is described in the Ver Snyder U.S. Pat. No. 3,260,505. Because of the long slow cooling rates, the alloys poured, which many times contain some relatively reactive constituents, are left exposed to the hot mold for long periods of time. With silica bonds, such exposure causes a reaction with the bond by some alloys and produces a casting having a relatively poor surface and relatively poor high temperature properties.

Further when an alloy is poured into a ceramic mold, which is usually around 1800° F. in normal casting operations, the alloy almost immediately solidifies, or else it solidifies immediately adjacent to the mold, because of the wide discrepancy in temperature. This solidification means a crystal formation and accordingly the casting comes out as an equiaxed grain casting. In directional solidification, the technique is to start the crystal growth from the base of a blade; for example, to grow vertically or longitudinally to form a long crystal in the direction of the blade length for best results. The less the discrepancy between the metal temperature and the mold temperature, the greater are the probabilities of being able to do this. Ideally, a mold should be at least the solidification point of the alloy or above, so that when the metal is poured in, it will not immediately solidify adjacent to the mold surface, but then the cooling can be controlled from any direction that it is desired to do so. Therefore, by having molds that are higher than normal casting temperatures, more control on grain structure can be obtained. The general maximum use temperature now is about 2500° F. mold temperature. Anything above this leads to softening of the silica bonds now normally used and aggravates reactivity problems.

One attempt to overcome the reactivity problems with silica molds is described in U.S. Pat. No. 3,933,190 relating to the use of an aluminum polyoxychloride binder with an alumina refractory to form the mold. However, this type of binder has very poor green and elevated temperature strengths, thereby making it difficult to dewax the mold without cracking and destroying the mold surface. Likewise the aluminum polyoxychloride is soluble in steam, which does not permit the mold to be autoclave dewaxed.

Some observers have shown that alumina is relatively inert compared to silica with most nickel and cobalt based alloys containing minor quantities of reactive components. However, a totally satisfactory all-alumina shell mold has not yet been developed.

OBJECTS AND BRIEF SUMMARY OF THE INVENTION

An object of this invention is to provide an improved high temperature refractory coating.

Another object is to provide an improved high temperature shell mold.

Another object is to provide an essentially all-alumina final shell mold for use in producing directionally solidified castings.

Yet another object of this invention is to provide a non-reactive mold surface for alloys containing reactive components.

These and other objects are realized by the present invention wherein the binder for making the shell mold comprises a fibrous colloidal alumina in aqueous dispersion, the binder being essentially free of silica.

By use of the above binder, the resulting mold exhibits excellent green strength which facilitates dewaxing in an autoclave or by other means.

The mold of the present invention also retains sufficient strength during the dewaxing operation to prevent cracking of the mold and has sufficient strength to permit preheating temperatures up to about 3100° F., e.g. 2750° to 3100° F.

Further, by virtue of the fact that an all-alumina system is provided, alloys containing reactive components such as nickel and cobalt-based alloys containing one or more of hafnium, zirconium, tungsten, aluminum, titanium, niobium, molybdenum, carbon, silicon, maganese or yttrium, can be poured without adverse effects due to their reactivity.

DETAILED DESCRIPTION

The basic method for making the shell mold comprises making an expendable pattern of a part to be cast, dipping the expendable pattern into a slurry of a ceramic powder and a binder to form a moist coating on a wax pattern, sprinkling a coarse refractory poweder on said moist coating, drying said moist coating, and repeating dipping, sprinkling and drying, whereby said shell mold is built up to a desired thickness.

The binder of the present invention employs a fibrous colloidal alumina, particularly as an aqueous sol. Needless to say, the binder should be essentially free of silica to avoid the above-discussed reactivity problems. The fibrous colloidal alumina binder of the present invention may be prepared by the teachings of U.S. Pat. Nos. 2,915,475 and 3,031,417 as well as of an article by Bugosh, J. Phys. Chem. 1789–1798 (Oct., 1961), all incorporated by reference herein.

The material is described by Bugosh as having a boehmite-type lattice.

An electron microscope photograph taken of this material shows a fibrous intertwined structure and it is believed that this structure is the essential property for purposes of the present invention.

Upon drying, high green strength is imparted to the refractories in the slurry. This sol is desirably stabilized in the pH range of from about 3.0 to about 4.5 with inorganic or organic acids, depending upon the characteristics desired. The sol is conveniently employed at concentrations of up to about 10% by weight $Al_2O_3$, and at higher concentrations, there is a tendency to gel.

Upon drying and heating the alumina sol, it changes from an amorphous to gamma alumina, zeta alumina and to alpha alumina depending upon the heating temperature. Being essentially pure alumina, after drying and calcining, the resulting bond has a very high melting point. The melting point given by Gitzen in the book "Alumina as a Ceramic Material", page 64 is given at 2051±9.7° C. (alpha alumina). The alumina sol bonding system, therefore, when mixed with refractory alumina, such as tabular alumina or fused alumina, produces a superior refractory mold, having a high distortion temperature. Thus, mold preheating temperatures approaching 2000° C. should be used without softening of the mold.

A variety of refractories can be used as mentioned, depending upon the particular application.

Thus, for example, useful refractories include one or more of quartz, fused silica, monoclinic zirconia, stabilized electrically fused zirconia, mullite, aluminosilicates, calcined alumina, fused alumina, ceria or yttria.

In the case of directionally solidified castings, alumina or a non-reactive refractory is best used. Typical examples of a suitable alumina refractory is fused alumina (Norton Grade 38), or tabular alumina (Alcoa Grade T-61). Stabilized zirconia having a very high softening temperature may also be used for high temperature mold structures. Yttria, also having a very low reactivity with reactive metals, may be desirable for mold surfaces bonded with the alumina sol.

An acid such as HCl may be used in the slurries of alumina sol and alumina to retain the alumina sol in a stabilized condition, since it has a tendency to gel outside of its normal stable range. Because the various refractories contain some very small amounts of impurities such as alkalis, and this is particularly true with the commercial tabular alumina, the slightly acidic nature of the alumina sol has an effect on this alkali in the fine flours used and therefore the pH of the sol changes. The acid is used to retain the sol over a period of time of use of the slurry in its stable range.

The number of alumina sol bonded coats may also vary depending upon the needs of the particular application.

The alumina sol, after each coat may be further insolubilized by treatment with ammonia vapors. Exposure to ammonia vapors causes the alumina sol to increase in pH, thereby bringing it out of the stable range and causes a preliminary set. It should be mentioned also that ammonia setting of the complete shell after dipping causes the entire shell to set and become water resistant. Prior to that, it is less water resistant than without ammonia.

For some applications, it may be desirable to apply only one or two coats of refractory bonded with alumina sol, and then back up the remaining coats with either a solid mold structure of additional shell structure containing a different bond, such as colloidal silica or hydrolyzed ethyl silicate.

For some of the more reactive alloys, all that is needed is for the casting mold surface to be free from reactive materials and therefore a single coating of an alumina sol-bonded alumina, ceria, yttria, or zirconia mold, is thought to be adequate for most of the reactive alloys. This coating can then be backed up with either a solid mold structure or by another type of shell mold structure.

In effect, as long as there is totally non-reactive surface, i.e. by utilization of the present invention, it can be backed up with any other kind of a mold system that will withstand the coasting conditions and alloys containing reactive metals.

Various aspects of the present invention will now be illustrated with reference to the following Examples which are not to be taken as limitative.

EXAMPLE 1

A slurry was prepared by mixing 330 ml of a fibrous alumina sol containing about 10% by weight alumina (the sol having a pH of 3.6, inorganic acid stabilizer) with 970 grams of a 325-mesh tabular alumina flour. Two drops of Sterox NJ (available from Monsanto Chemical Co.) wetting agent, 15 drops 2-ethylhexanol defoaming agent and 6 drops 37% hydrochloric acid were also added. The 2-ethylhexanol is normally put into slurries as a defoaming agent, and will minimize the foaming tendency or bubble formation, which bubbles would show up as roughness in the casting. This composition was mixed until a homogeneous, bubble-free dispersion was obtained having a viscosity of 25 seconds; #4 Zahn cup. Rectangular sheets of wax patterns were dipped into this dispersion after it had mixed for 24 hours in order to obtain specimens for modulus of rupture for the system. After dipping the first coat, a coarse stucco powder, Alundum 38, 70-grain, was sprinkled over the moist coating. This coating was dried and a second dip was applied in the same fashion. using the same coarse stucco after the viscosity of the slurry was reduced to 15 seconds by the #4 Zahn cup. The third coat was applied and to the moist third coat was applied 14×28 tabular alumina stucco. This was repeated through the sixth dip, after which a seventh dip was applied without any stucco. The patterns were then thoroughly dried. The wax was removed by melting.

The flat shell specimens on each side of the wax sheet were then cut into test specimens by means of a diamond saw to 1" width by 2½" length test specimen. These were tested on a Transverse loading machine for breaking strength. Four specimens were broken at room temperature to give an average modulus of rupture of 1012 psi.

EXAMPLE 2

330 ml of the fibrous alumina sol of Example 1 were mixed with 1290 grams 325-mesh tabular alumina, 6 drops 37% HCl, 2 drops Sterox NJ, and 15 drops 2-ethylhexanol to a viscosity of 25 seconds. The first coat was applied and stuccoed with the 70 grain Alundum-38 as in Example 1. The viscosity of the slurry was reduced to 15 seconds; #4 Zahn cup. The second coat was applied and stuccoed with the same stucco. The third coat was applied and stuccoed with 28×48 tabular alumina. After drying, the fourth coat was applied and stuccoed with the same material. The fifth and sixth coats were applied and stuccoed with 14×28 mesh tabular alumina and then a seventh seal coat was applied. However, a difference in treatment was applied to this Example, namely after drying the coating for 30 minutes after each stucco, it was given a 30 minute treatment in an ammonia atmosphere prior to completion of drying of the individual coats. The final dipped specimens were then completely dried and the wax melted out at low temperature of about 80° C.

The sheets of the ceramic shell were then cut into specimens similarly to those formed in Example 1.

A total of 6 specimens were tested at room temperature to give an average modulus of rupture of 855 psi. Additional specimens were heated to 2500° F. in an electric furnace, held at this temperature for 1 hour and then allowed to cool in the furnace to room temperature. They were then tested at room temperature for modulus of rupture. Two specimens gave an average of 1275 psi. Two specimens were heated to 2300° F. and held for one hour and cooled in the furnace. These gave a modulus of rupture of 584 psi. Another specimen was heated to 2800° F., held for one hour, and allowed to cool in the furnace at room temperature and tested. All of the test values for these specimens are sufficiently high for casting.

EXAMPLE 3

To 400 ml of the fibrous alumina sol of Example 1 were mixed 20 drops 2-ethylhexanol and 1160 gms Remasil 60, RP-325CG (an aluminosilicate of Remet Corporation). The refractory is basically a −325 mesh fine flour. This slurry was mixed until it became homogeneous and free of bubbles and at 25 seconds viscosity was then used for dipping test specimens similar to the preceding Examples. After the first dip was applied it was stuccoed with a nominal 70 grain Remasil 60. Alumina sol was then added to the slurry to reduce the viscosity to 15 seconds. The second coat was applied and stuccoed with the same grain as the first. The third coat was applied after the second had dried and was stuccoed with Remasil 60, nominally 40 grain size. This was repeated on #4. The fifth and sixth dips were applied after previous coats were individually dried and stuccoed with nominal 20 grain stucco. A seventh seal coat was applied without any stucco. After the final coating had been applied, the entire pattern was dried and wax was removed as in preceding Examples.

Specimens were cut and tested at room temperature. An average of four specimens showed a modulus of rupture of 511 psi. Specimens were also fired at 1800°, 2300° and 2500° F. Several specimens showed an average modulus of rupture of 256 psi when fired to 1800, 309 psi when fired to 2300° F. and 716 psi when fired to 2500° F.

EXAMPLE 4

Zircon flour was used to produce a slurry with the alumina sol wherein 330 ml of the alumina sol of Example 1 were mixed with 1215 grams of zircon flour, 31 325 mesh, and containing 3 drops 37% HCl, 2 drops Sterox NJ, and 10 drops 2-ethylhexanol. The viscosity was made to 25 seconds; #4 Zahn cup and the first coat then applied to similar pattern sheets. The stucco used was a nominal 70 grain fused alumina and then the viscosity of the slurry was reduced to 15 seconds by the addition of alumina sol. The second coat was applied and stuccoed with the same stucco as on the first. The third coat was applied after drying of the preceding coat and stuccoed with −28+48 mesh tabular alumina. This coat was dried and the fourth coat was applied and stuccoed with the same stucco. The fifth and sixth coats were applied, but stuccos used were −14+28 mesh tabular alumina. A final seventh coat was applied as a seal coat.

After drying and cutting specimens, they were tested for modulus of rupture. The green strength averaged 585 psi. The strength at 1800° F. was 288 psi and 2300° F.—446 psi.

EXAMPLE 5

A slurry similar to the preceding Examples was made with a 330 ml fibrous alumina sol and 1240 grams −325 mesh tabular alumina and 9.7 grams Fiberfrax fiber (available from Carborundum Co.). Two drops of Sterox NJ, 15 drops 2-ethylhexanol and 6 drops 37% HCl were also added and mixed to a viscosity of 25 seconds. Specimens were dipped and stuccoed the same as in the preceding Example. The following are the modulus of rupture values:

| | |
|---|---|
| Green | 557 psi |
| 1200° F. | 441 psi |
| 2300° F. | 696 psi |
| 2500° F. | 1588 psi |

EXAMPLE 6

406 ml. of fibrous alumina sol were mixed with 4 drops concentrated HCl, 3 drops Sterox NJ, 10 drops 2-ethylhexanol, and 2200 grams −325 mesh calcia stabilized zirconia flour. After the bubbles were removed and a smooth homogeneous mix was made, the first dip was applied. The stucco was made of −50+100 mesh electrically fused calcia stabilized zirconia. The viscosity of the slurry was then reduced from 25 seconds to 15 seconds by the addition of alumina sol. The second dip was applied after the first had dried. The same stucco was used on the second dip. Four additional coats were applied and stuccoed with −12+35 mesh electrically fused calcia stabilized zirconia, and a seventh seal coat was finally applied.

After drying and cutting into specimens, the following modulus of rupture values were obtained.

| | |
|---|---|
| Green | 754 psi |
| 2500° F. | 910 psi |

EXAMPLE 7

A slurry was prepared using 515 ml of fibrous alumina sol and 1200 grams 325 mesh silica flour, 6 drops Sterox NJ, 4 drops 2-ethylhexanol. After a homogeneous mix free of bubbles was obtained, patterns were dipped in a fashion similar to previous Examples. For the first three coats, a nominal −50+100 mesh fused silica stucco was used. The slurry was reduced in viscosity from 25 seconds to 14 seconds after the first coat. The fourth through sixth coats were applied and stuccoed with a nominal −20+50 mesh fused silica, and a final seal coat was used without stucco.

Specimens were dried and cut. Green strength was noted at 930 psi for an average of four specimens. When specimens were fired to 1800° F., strengths of 329 psi were obtained on an average of three specimens. At 2300° F. a strength of 500 psi was obtained on the specimen. This indicated a stability of the fused silica-slumina sol system in comparison to a colloidal-silica bonded system, wherein the silica bond deteriorates to low values when fired from 1800° to 2000° F.

EXAMPLE 8

A slurry was prepared using a calcined alumina refractory having the following particle size distribution: 100%-below 20 microns, 95%-10 microns, 65%-5 microns, 15%-1 micron. 2,000 grams of this refractory was mixed with 50 ml of the alumina sol of Example 1 and 3 drops concentrated hydrochloric acid. This produced a viscosity of 18 seconds; #4 Zahn cup. The first dip coat was applied to wax rectangular test specimens in a manner described before and was stuccoed with 70 grain Fused Alundum 38 and allowed to dry. The slurry was then reduced in viscosity to 15 seconds by the addition of a small amount of fibrous alumina sol. A second dip was applied and stuccoed with the same 70 Grain Alundum 38. This was allowed to dry and the third and fourth coats were applied, each being stuccoed with tabular alumina of approximately 28 to 48 mesh size. After drying, the fifth coat was applied and stuccoed with tabular alumina of about 14 to 28 mesh and allowed to dry. The sixth coat was applied in the same manner, dried, and then a seventh seal coat was applied without any stucco. Modulus of rupture values were obtained on specimens that were fired to the respective temperatures indicated and cooled back to room temperature and then tested.

| Green | Firing Temperature °F. | MOR lbs. per sq. inch |
|---|---|---|
| " | Room | 1385 |
| " | 1200 | 692 |
| " | 1800 | 901 |
| " | 2000 | 868 |
| " | 2300 | 1631 |
| " | 2500 | 1992 |

It is noted that this composition retained its strength in the intermediate temperature ranges and that fairly high modulus of rupture values were obtained at the elevated temperatures.

EXAMPLE 9

The following is a further example of a slurry prepared using a fibrous alumina sol having a pH of 4.8 (organic acid stabilizer) with the same refractory as described in the preceding example. 2000 grams of the refractory were mixed with 600 ml of alumina sol 200 and 12 drops of concentrated hydrochloric acid to give a viscosity of 35 seconds; #4 Zahn cup. Dipping was carried out in the same fashion as the preceding example and using the same stucco materials for the various coats. After the first coat additional alumina sol 200 was added to reduce the viscosity to 15 seconds. Two series were run, however, in which the first series was dried in the same manner as coatings in the preceding example. The next series was carried out by placing the test specimen in an atmosphere of ammonia gas immediately after the stucco operation for a period of ten minutes. The specimen was removed and air dried completely before the next dip was applied. This ammonia treatment was repeated on each coating and results were obtained separately on the treated versus the untreated samples. To date we only have results in the green and 2500° F. fired condition. The untreated samples showed a 780 psi MOR unfired and 2500° heated samples showed a 1240 psi. On the treated samples, the unfired values are 367 psi and those fired at 2500° averaged 839 psi.

It is contemplated that the instant binder and refractory material bound thereby find a wide variety of applications other than in shell molds, for example, other types of molds and equipment which require durability at elevated temperatures, especially where contact with reactive molten metal, e.g. at temperatures between 2000° to 3100° F. is involved.

I claim:

1. In a method for making a shell mold which comprises:
   a. making an expendable pattern of a part to be cast,
   b. dipping the expendable pattern into a slurry of a refractory material and a binder to form a moist coating on said pattern,
   c. sprinkling a coarse refractory powder on said moist coating,
   d. drying said moist coating, and
   e. repeating steps b, c and d, whereby said shell mold is built up to a desired thickness, the improvement wherein said binder consists essentially of an acid stabilized, fibrous colloidal alumina as an aqueous sol, said binder being essentially free of silica and said binder developing excellent green strength.

2. The method according to claim 1 wherein the fibrous alumina is acid stabilized at a pH of about 3.0 to 4.5.

3. The method according to claim 1 wherein the refractory material comprises one or more of quartz, fused silica, monoclinic zirconia, stabilized electrically fused zirconia, mullite, aluminosilicates, calcined alumina, fused alumina, ceria or yttria.

4. The method according to claim 1 wherein the refractory material comprises one or more of alumina, zirconia or yttria.

5. The method according to claim 1 wherein the shell mold comprises two coats of refractory, each coat being bonded with said colloidal alumina binder and said shell mold being supported by a solid mold structure.

6. The method according to claim 1 wherein the shell mold comprises one coat of refractory, said coat being bonded with said colloidal alumina binder and said shell mold being supported by a solid mold structure.

7. The method according to claim 1 wherein the shell mold comprises one coat of refractory bonded with colloidal alumina being supported by an additional shell structure employing a different binder than said alumina.

8. The method according to claim 1 wherein the expendable pattern is a wax pattern.

9. The mold produced by the method of claim 1.

10. In a method for producing castings of alloys having directionally solidified grains wherein a molten alloy is poured into a shell mold, the improvement which comprises employing as the shell mold one produced by a method comprising:

a. making an expendable pattern of a part to be cast,
b. dipping the expendable pattern into a slurry of a refractory material and a binder to form a moist coating on said pattern,
c. sprinkling a coarse refractory powder on said moist coating,
d. drying said moist coating, and
e. repeating steps b, c and d, whereby said shell mold is built up to a desired thickness, said binder consisting essentially of an acid stabilized, fibrous colloidal alumina as an aqueous sol, said binder being essentially free of silica, and said binder developing excellent green strength.

11. The method according to claim 10 wherein th alloy comprises nickel and cobalt and one or more of hafnium, zirconium, tungsten, aluminum, titanium, niobium, molybdenum, carbon, silicon, manganese or yttrium.

12. The method according to claim 11 wherein the alloy comprises nickel or cobalt and one or more of zirconium, aluminum or titanium.

13. The method according to claim 10 wherein the mold is heated to 2000° F. to 3100° F. prior to pouring the molten alloy therein.

14. The method according to claim 10 wherein the mold is heated to 2750° F. to 3100° F. prior to pouring the molten alloy therein.

15. The method according to claim 10 wherein the refractory comprises one or more of alumina, ceria, zirconia and yttria.

16. In method for casting an alloy comprising pouring a molten alloy in a shell mold, the improvement which comprises forming the shell mold from a slurry of binder and a refractory material, wherein said binder consists essentially of an acid stabilized, fibrous colloidal alumina as an aqueous sol, said binder being essentially free of silica, and said binder developing excellent green strength.

17. The method according to claim 16 wherein the mold is preheated to an elevated temperature prior to pouring molten alloys therein.

18. The method according to claim 17 wherein the mold is heated to 2000° to 3100° F. prior to pouring the molten alloy therein.

19. The method according to claim 17 wherein the mold is heated to 2750° F. to 3100° F. prior to pouring the molten alloy therein.

20. The method according to claim 16 wherein the refractory comprises one or more of alumina, ceria, zirconia and yttria.

21. In a method of making a shell mold refractory coating comprising dipping a pattern into a slurry of binder and a refractory material, the improvement wherein said binder consists essentially of an acid stabilized, fibrous colloidal alumina as an aqueous sol, said binder being essentially free of silica, and said binder developing excellent green strength.

22. The shell mold produced by the process of claim 21.

* * * * *